US010391413B2

(12) United States Patent
Yamada

(10) Patent No.: US 10,391,413 B2
(45) Date of Patent: Aug. 27, 2019

(54) SWINGING APPARATUS AND AMUSEMENT RIDE INCLUDING THE SAME

(71) Applicant: SENYO KOGYO CO., LTD., Osaka-shi, Osaka (JP)

(72) Inventor: Yusaku Yamada, Osaka (JP)

(73) Assignee: SENYO KOGYO CO., LTD., Osaka (JP)

( * ) Notice: Subject to any disclaimer, the term of this patent is extended or adjusted under 35 U.S.C. 154(b) by 0 days.

(21) Appl. No.: 15/737,260

(22) PCT Filed: Jan. 31, 2017

(86) PCT No.: PCT/JP2017/003406
§ 371 (c)(1),
(2) Date: Dec. 15, 2017

(87) PCT Pub. No.: WO2018/142462
PCT Pub. Date: Aug. 9, 2018

(65) Prior Publication Data

US 2018/0369701 A1 Dec. 27, 2018

(51) Int. Cl.

| | |
|---|---|
| ***A63G 31/04*** | (2006.01) |
| ***A63G 31/16*** | (2006.01) |
| ***A47C 1/00*** | (2006.01) |
| ***A47C 7/14*** | (2006.01) |
| ***A47C 7/00*** | (2006.01) |

(Continued)

(52) U.S. Cl.
CPC ..... *A63G 31/04* (2013.01); *A47C 1/00* (2013.01); *A47C 7/002* (2013.01); *A47C 7/144* (2018.08); *A63G 31/16* (2013.01); *A63J 25/00* (2013.01)

(58) Field of Classification Search
CPC ..... A63G 31/00; A63G 31/02; A63G 31/04; A63G 31/08; A63G 31/16; G09B 9/00; G09B 9/08; G09B 19/00; G09B 19/16
USPC ..... 472/3, 59–61, 130; 434/29, 55
See application file for complete search history.

(56) References Cited

U.S. PATENT DOCUMENTS 6,095,926 A * 8/2000 Hettema ..... A63G 31/16 104/85
6,162,058 A * 12/2000 Yang ..... A63G 31/16 434/29

(Continued)

FOREIGN PATENT DOCUMENTS

JP 6-210066 A 8/1994
JP 2000-276040 A 10/2000

(Continued)

OTHER PUBLICATIONS

International Search Report for the Application No. PCT/JP2017/003406 dated Apr. 25, 2017.

*Primary Examiner* — Kien T Nguyen
(74) *Attorney, Agent, or Firm* — Cheng Law Group, PLLC

(57) ABSTRACT

The swinging apparatus includes a base, a support located above the base, a coupler disposed between the base and the support and including a universal joint, and linear actuators disposed between the base and the support. Each of the linear actuators includes a first end and a second end located on an opposing side to the first end. The first end is mechanically connected to one of the base and the support. The second end is configured to freely move touching a surface of the other of the base and the support.

20 Claims, 17 Drawing Sheets

(51) Int. Cl.
*A63J 25/00* (2009.01)
*G09B 9/00* (2006.01)

(56) References Cited

U.S. PATENT DOCUMENTS

| | | | | |
|---|---|---|---|---|
| 6,462,769 | B1 * | 10/2002 | Trowbridge | A63G 31/16 348/51 |
| 6,733,293 | B2 * | 5/2004 | Baker | G09B 9/08 434/55 |
| 2005/0014566 | A1 * | 1/2005 | Hashimoto | A63G 31/16 472/59 |
| 2009/0163283 | A1 | 6/2009 | Childress | |
| 2015/0157951 | A1 * | 6/2015 | Lee | A63G 31/16 472/130 |

FOREIGN PATENT DOCUMENTS

| | | | |
|---|---|---|---|
| JP | 2006-102288 | A | 4/2006 |
| KR | 10-2013-0114349 | A | 10/2013 |

* cited by examiner

SWINGING APPARATUS AND AMUSEMENT RIDE INCLUDING THE SAME

TECHNICAL FIELD

The present invention relates to swinging apparatuses and amusement rides including the swinging apparatuses and, specifically, to a swinging apparatus configured to swing a support for carrying a user by linear actuators and an amusement ride including the swinging apparatus.

BACKGROUND ART

A swinging apparatus including a base, a support installed above the base, and linear actuators coupled to the base and the support has been proposed.

For example, a conventional swinging apparatus described Patent Literature 1 includes six linear actuators each mechanically connected to a base and a support. In the swinging apparatus, the six linear actuators support the load of the support, and a combination of extension and contraction movements of the linear actuators realizes various swinging motions of the support.

However, in the above-described conventional swinging apparatus, the six linear actuators have to be responsible for both force for swinging the support and force for reliably supporting the support and a user so that the user does not fall down also when the support is strongly swung. Thus, the entire size of a mechanism including the six linear actuators increases, which requires a large installation area for installation of the swinging apparatus.

Moreover, in the above-described conventional swinging apparatus, each of the six linear actuators is mechanically connected to the base and the support, and therefore, when one of the six linear actuators is stopped, the operation of other mechanisms may be locked as a consequence of the stopped linear actuator, which may lead to a risk of breakage of the mechanisms and/or a risk of falling down of a user.

In the above-described conventional swinging apparatus, since each of the six linear actuators is mechanically connected to the base and the support, precise coordination of the six linear actuators in terms of the extension and contraction movement is also required so as to realize various motions of the support, which requires very complicated control.

CITATION LIST

Patent Literature

Patent Literature 1: JP 2000-276040 A

SUMMARY OF INVENTION

It is an object of the present invention to provide a swinging apparatus and an amusement ride including the swinging apparatus, wherein the swinging apparatus can prevent a fall of a user by a compact mechanism, reduces the occurrence of damage to the mechanism even in the case of occurrence of a problem in a linear actuator, and additionally, can realize various swinging motions of the support by simple control.

A swinging apparatus according to one aspect of the present invention includes a base, a support, a coupler, and linear actuators. The support is installed above the base and configured to carry a user. The coupler is disposed between the base and the support and includes a universal joint that couples the support to the base and that allows the support to swing freely. The linear actuators are disposed between the base and the support so that in a plan view the linear actuators are located a distance away from each other at locations away from the universal joint.

Each of the plurality of linear actuators includes a first end and a second end. The first end is mechanically connected to one of the base and the support. The second end is located on an opposing side to the first end and is configured to be freely move touching a surface of a remaining one of the base and the support.

An amusement ride according to one aspect of the present invention includes the above-described swinging apparatus, a truck in which the swinging apparatus is installed, and a rail installed such that the truck runs on the rail.

An amusement ride according to another aspect of the present invention includes the above-described swinging apparatus, and a floor of a building, the base of the swinging apparatus being installed on the floor.

DESCRIPTION OF EMBODIMENTS

One Embodiment

Figure 1:
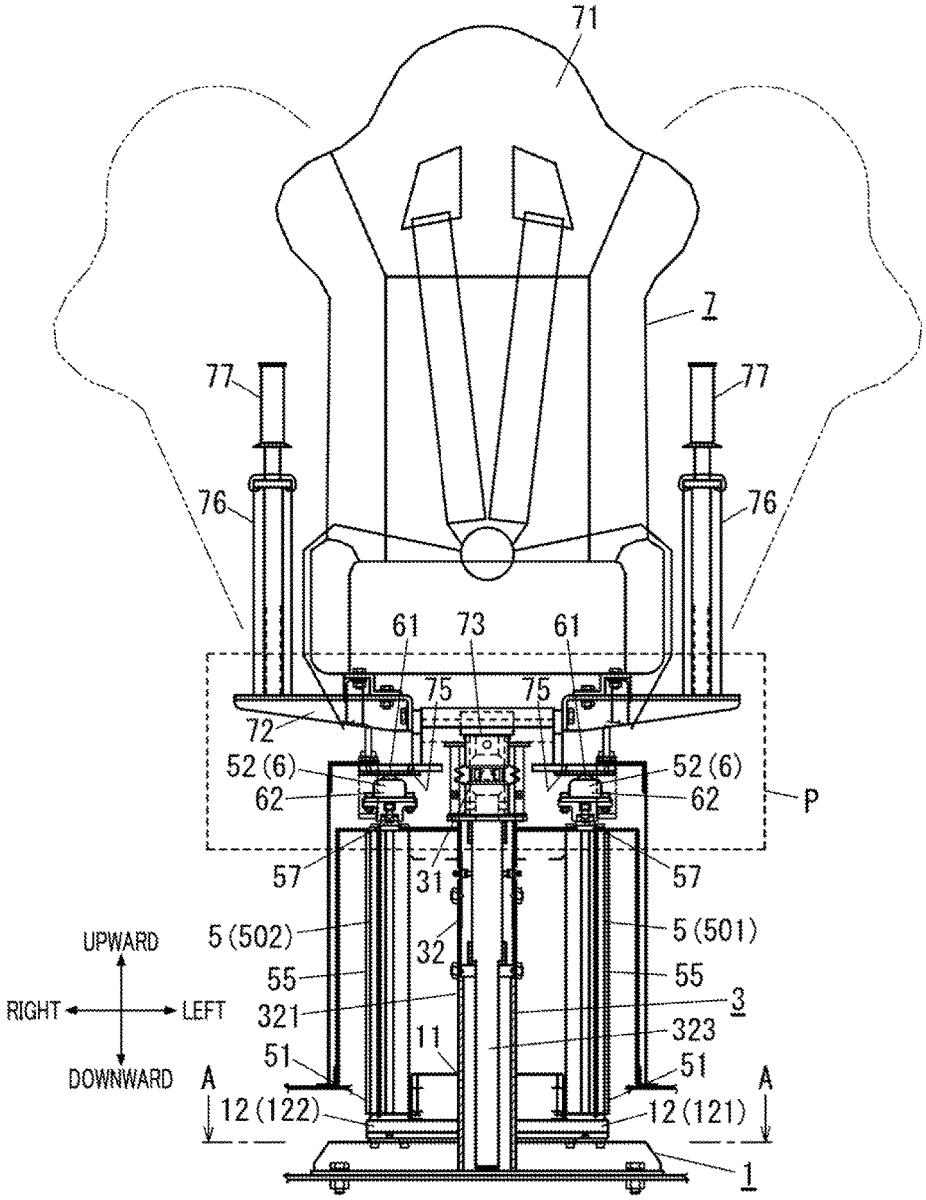
FIG. 1 is a partially cutaway front view illustrating a swinging apparatus of one embodiment.
Figure 2:
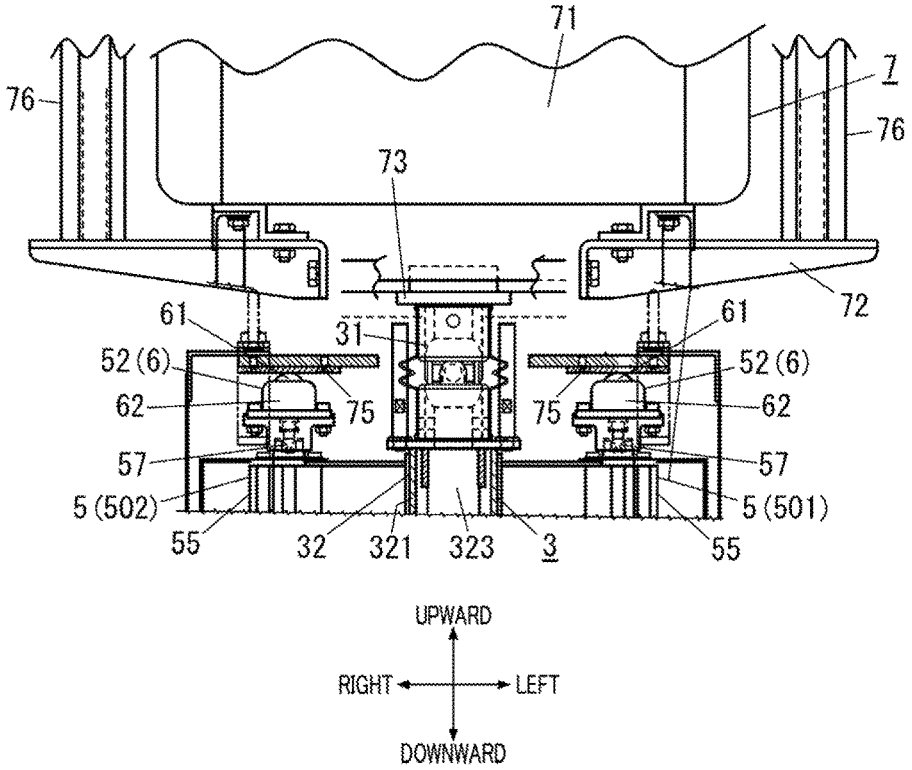
FIG. 2 is an enlarged view of part P in FIG. 1.

A swinging apparatus according to one embodiment will be described with reference to the attached drawings. The swinging apparatus according to the one embodiment includes a support 7 including a seat 71 and is configured to freely rock (swing) the support 7 with respect to a base 1 to give various positions, postures, and acceleration rates to a user who sits on the seat 71.

Overall Configuration

The overall configuration of the swinging apparatus according to the one embodiment will be schematically described.

As illustrated in FIGS. 1 to 5, the swinging apparatus according to the one embodiment includes the base 1, the support 7 installed above the base 1, a coupler 3 disposed between the base 1 and the support 7, a plurality of (in the one embodiment, four) linear actuators 5 disposed between the base 1 and the support 7, and a controller 8 configured to control the extension and contraction movement of the plurality of linear actuators 5. The coupler 3 has a columnar structure rising vertically upward from the base 1. Each of the plurality of linear actuators 5 is located parallel to the coupler 3.

In the swinging apparatus according to the one embodiment, each linear actuator 5 is not mechanically connected to the base 1 and the support 7 as in the conventional technique but is mechanically connected to only one (in the one embodiment, the base 1) of the base 1 and the support 7 and is not mechanically connected to the other (in the one embodiment, the support 7) of the base 1 and the support 7.

In the swinging apparatus according to the one embodiment, the coupler 3 is mechanically connected to both the base 1 and the support 7. The base 1 and the support 7 are coupled via the coupler 3 including a universal joint 31 that allows the support 7 to freely swing in all directions.

Configurations of the swinging apparatus according to the one embodiment will be described in further detail below. Directions such as the forward-rearward direction, the right-left direction, and the like used in the following description are defined with reference to a user riding on the support 7.

Base

Figure 3:
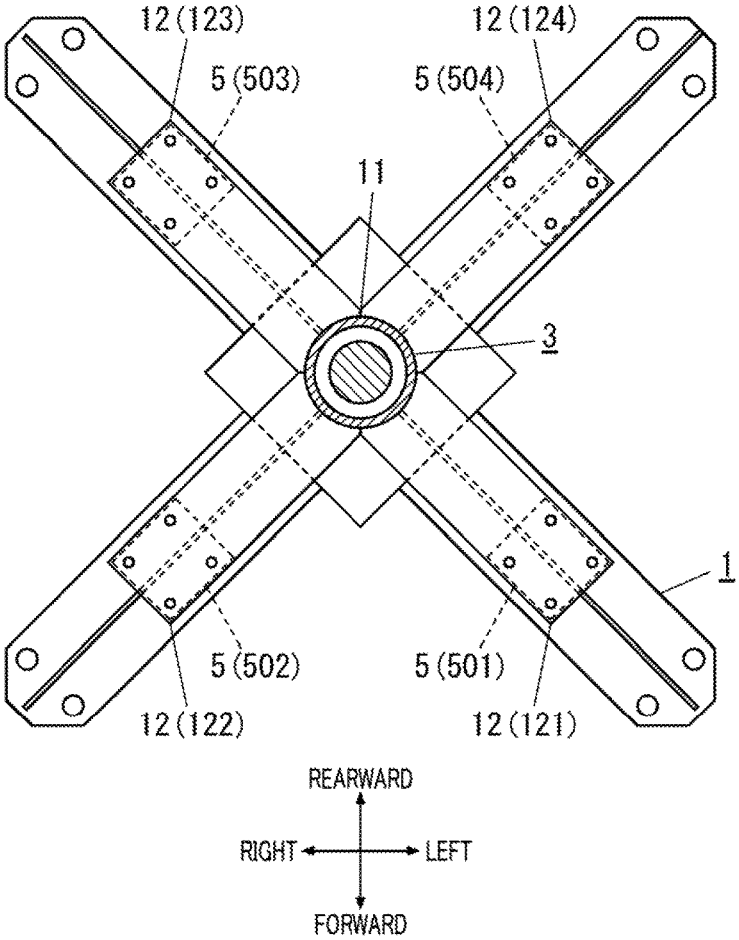
FIG. 3 is a sectional view taken along line A-A in FIG. 1.
Figure 4:
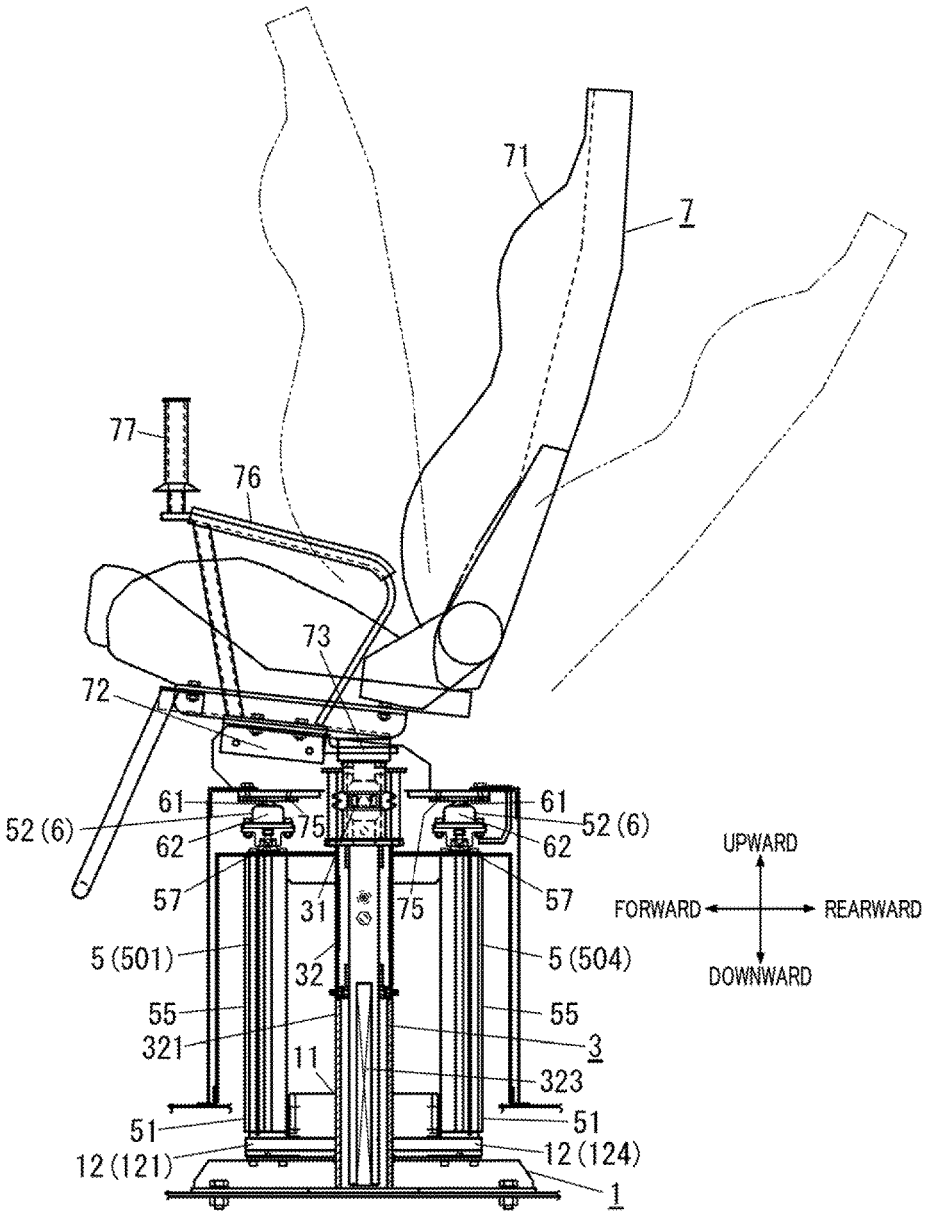
FIG. 4 is a partially cutaway side view illustrating the swinging apparatus.

The base 1 is a part installed in an appropriate ride (e.g., a later-described truck 91) and includes a connection section 11 mechanically connected to a lower end of the coupler 3, and a plurality of (four) connection sections 12 mechanically connected to respective lower ends of the plurality of linear actuators 5 (see for example, FIG. 3).

In a plan view, the connection section 11 is located at a center portion of the base 1, and the plurality of connection sections 12 are located to surround the base 1. The plurality of connection sections 12 are located on an identical circumference with the connection section 11 as the center and are located a distance (an equal distance) away from each other in the circumferential direction.

The plurality of connection sections 12 include a first connection section 121 located at an obliquely forward left position with respect to the connection section 11 at the center, a second connection section 122 located at an obliquely forward right position with respect to the connection section 11, a third connection section 123 located at an obliquely rearward right position with respect to the connection section 11, and a fourth connection section 124 located at an obliquely rearward left position with respect to the connection section 11.

Coupler

The coupler 3 includes the universal joint 31 and a coupling column 32 coupled to the universal joint 31. The coupling column 32 is located below the universal joint 31 and is configured to be freely extendable and contractible in the vertical direction.

The coupling column 32 includes a tubular section 321 and a columnar section 323. The tubular section 321 has an opening which is open upward. The columnar section 323 is provided in the tubular section 321 to be freely movable upward and downward. The columnar section 323 has an upper end protruding upward through the opening of the tubular section 321. The amount of protrusion of the upper end of the columnar section 323 from the tubular section 321 is freely changeable within a predetermined range along with an upward and downward movement of the entire columnar section 323. Note that the coupler 3 is not an actuator which actively extends and contracts but the coupler 3 is configured to be passively extended and contracted by external force.

The universal joint 31 is mechanically connected to the upper end of the columnar section 323 and is mechanically connected to a lower portion of the support 7. The support 7 is coupled to the upper end of the columnar section 323 via the universal joint 31 that allows the support 7 to swing freely. The support 7 is configured to freely swing in all directions including the forward-rearward direction and the right-left direction with the universal joint 31 as the center.

Linear Actuator

Each of the linear actuators 5 is an actuator to be electrically driven to be extended and contracted in the vertical direction. Each linear actuator 5 has a first end 51 on one side in an axial direction of the linear actuator 5 and a second end 52 on the other side in the axial direction. The linear actuator 5 is configured such that the first end 51 and the second end 52 move toward and away from each other by externally supplied electric power. Note that the structure of the linear actuator 5 is not limited to a structure using electric power for extension and contraction, and a structure using pneumatics or hydraulics for the extension and contraction may be adopted.

The linear actuator 5 includes a tubular case 55 and a rod 57 arranged in the case 55 and is configured such that the rod 57 is moved upward and downward in the case 55 by a stepper motor. The case 55 has an opening which is open upward, and the rod 57 has an upper end protruding through the opening of the case 55. The case 55 has a lower end which is a fixing side of the linear actuator 5 and which forms the first end 51. The upper end of the rod 57 is a movable end of the linear actuator 5 and forms the second end 52.

The first end 51 is tightly connected to one of the plurality of connection sections 12 included in the base 1 with screws or the like. In a state where the first end 51 is connected to the connection section 12, the linear actuator 5 is installed upright vertically above the base 1.

The second end 52 includes a ball roller 6 configured to come into contact with the support 7. The ball roller 6 includes a ball 61 and a holding section 62 which holds the ball 61 such that the ball 61 is freely rotatable in all directions.

The ball 61 partially protrudes upward from the holding section 62. When the ball roller 6 comes into contact with the support 7, the ball 61 freely movably comes into contact with a lower surface of the support 7. Note that since the ball roller 6 is not mechanically connected to the support 7, separation of the ball roller 6 from the support 7 is also allowed depending on conditions.

In the swinging apparatus according to the one embodiment, the first connection section 121, the second connection section 122, the third connection section 123, and the fourth connection section 124 which form four parts of the connection section 12 are connected to the first ends 51 which are lower ends of the four linear actuators 5 on a one-to-one basis.

When the four linear actuators 5 are distinguished from one another in the following description, the linear actuator 5 at a left forward position, connected to the first connection section 121 is referred to as a first actuator 501, the linear actuator 5 at a right forward position, connected to the second connection section 122 is referred to as a second actuator 502, the linear actuator 5 at a right rearward position, connected to the third connection section 123 is referred to as a third actuator 503, and the linear actuator 5 at a left rearward position, connected to the fourth connection section 124 is referred to as a fourth actuator 504.

Support

The support 7 includes the one seat 71 configured to carry a user who sits on the seat 71 in a posture facing forward, a base seat section 72 provided below the seat 71 so as to support the seat 71, and a pair of right and left armrests 76 respectively installed upright above right and left ends of the base seat section 72. A grip bar 77 is further installed upright above each armrest 76.

In the seat 71, a vibration speaker may be installed. For example, when the vibration speaker is installed in a backrest surface and/or a seat surface of the seat 71, driving the vibration speaker in synchronization with the swinging of the support 7 can give a more realistic feeling to a user.

In the grip bar 77, a control device such as a joystick may be installed. When such a control device is installed, a further diversified simulation environment can be constructed.

In the base seat section 72, a connection section 73 and a plurality of (four) buffer members 75 are integrally provided. The connection section 73 is mechanically connected to the universal joint 31, and the plurality of buffer members 75 are installed to surround the connection section 73 in a plan view. The plurality of buffer members 75 are located on an identical circumference with the connection section 73 as the center and are located a distance (an equal distance) away from each other in the circumferential direction.

Each of the buffer members 75 has a lower surface which the ball roller 6 (ball 61) of the corresponding linear actuator 5 supports touching from below. The lower surface of each buffer member 75 has a part which the ball 61 supports touching, and the part can move in all directions including the forward-rearward direction and the right-left direction in the lower surface of the buffer member 75 along with the rotation of the ball 61. Each buffer member 75 is made of, for example, ultrahigh molecular weight polyethylene, but other materials may be adopted as long as they have a shock-absorbing property and a wear-resistant property.

Controller

Figure 5:
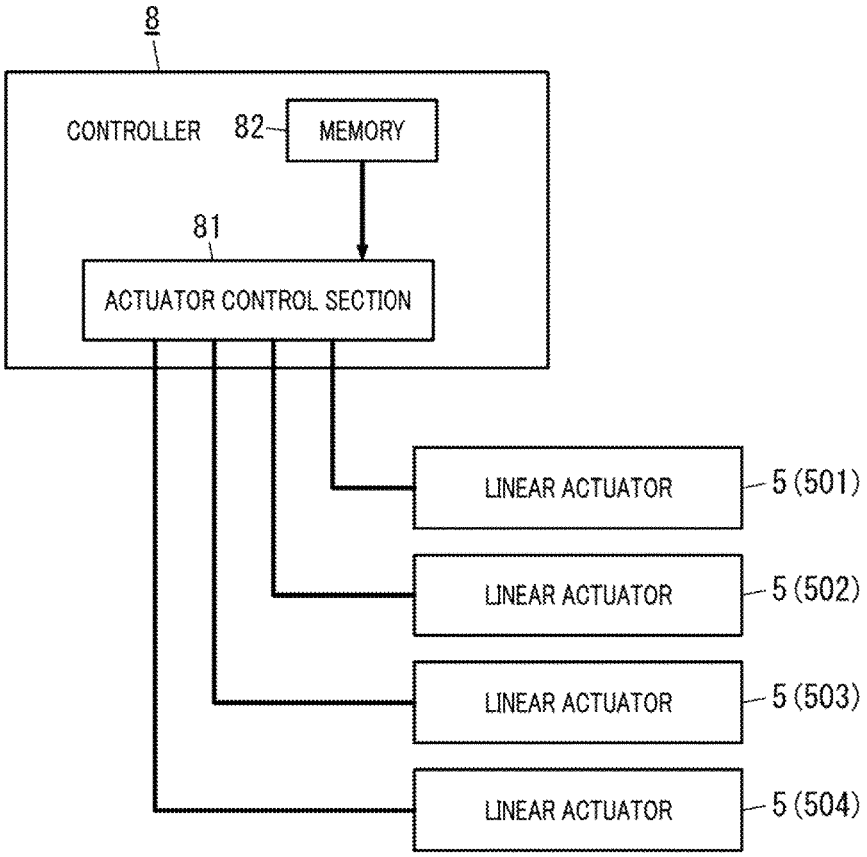
FIG. 5 is a block diagram illustrating a controller included in the swinging apparatus.

The controller 8 including a microprocessor as a main component includes an actuator control section 81 and memory 82 (see FIG. 5). The actuator control section 81 controls the extension and contraction movement of each of the first to fourth actuators 501, 502, 503, and 504 in accordance with a program stored in the memory 82 to realize swinging of the support 7 with the universal joint 31 as the center, an upward and downward movement of the support 7, and a combination thereof.

In FIGS. 6A-6D, states of the first to fourth actuators 501, 502, 503, and 504 are schematically illustrated. In FIGS. 6A-6D, the support 7 is shown by only the lower surface of the support 7, and the lower surface is indicated by a broken line.

Figure 6A:
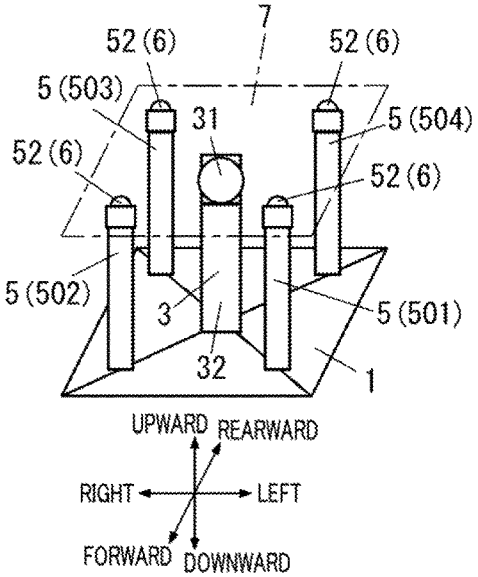
FIG. 6A is a schematic view illustrating a first state of a plurality of linear actuators included in the swinging apparatus.

FIG. 6A shows that all of the first to fourth actuators 501, 502, 503, and 504 are in the most contracted state (hereinafter referred to as a "first state"). In the first state, the second ends 52, which are upper ends, of all of the first to fourth actuators 501, 502, 503, and 504 are maintained at the lowest position. In this state, the support 7 is in a horizontal posture and is at the lowest position.

Figure 6B:
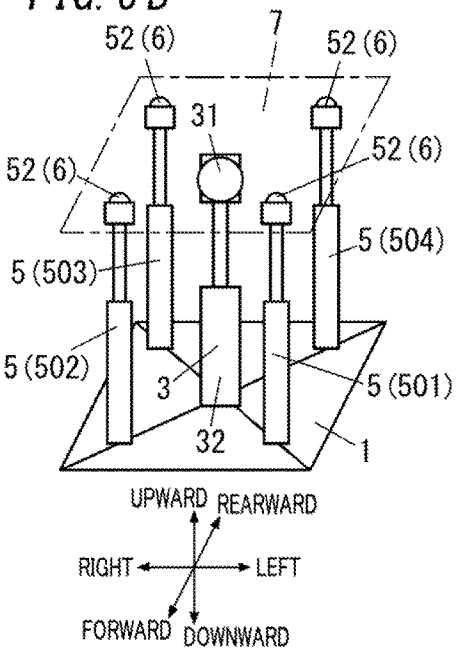
FIG. 6B is a schematic view illustrating a second state of the plurality of linear actuators.

FIG. 6B shows that all of the first to fourth actuators 501, 502, 503, and 504 are in the most extended state (hereinafter referred to as a "second state"). In the second state, the second ends 52 of all of the first to fourth actuators 501, 502, 503, and 504 are maintained at the highest position. In this state, the support 7 is in a horizontal posture and is at the highest position.

Figure 6C:
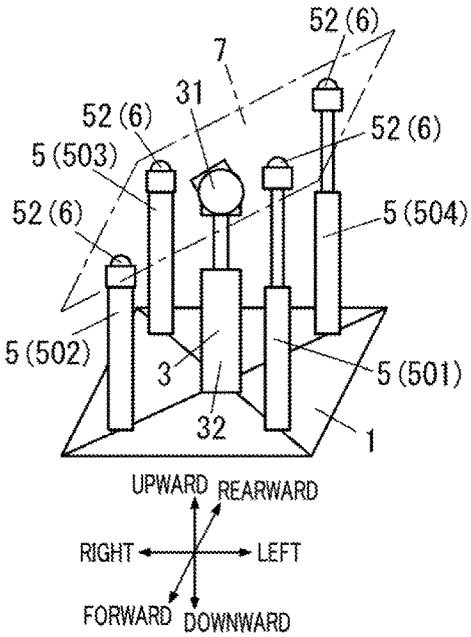
FIG. 6C is a schematic view illustrating a third state of the plurality of linear actuators.

FIG. 6C shows that the first actuator 501 and the fourth actuator 504 located on the left are more extended than the second actuator 502 and the third actuator 503 located on the right (hereinafter referred to as a "third state"). In the third state, the second ends 52 of the first actuator 501 and the fourth actuator 504 located on the left are located higher than the second ends 52 of the second actuator 502 and the third actuator 503 located on the right. In this state, the support 7 is in a posture inclined downward to the right.

Figure 6D:
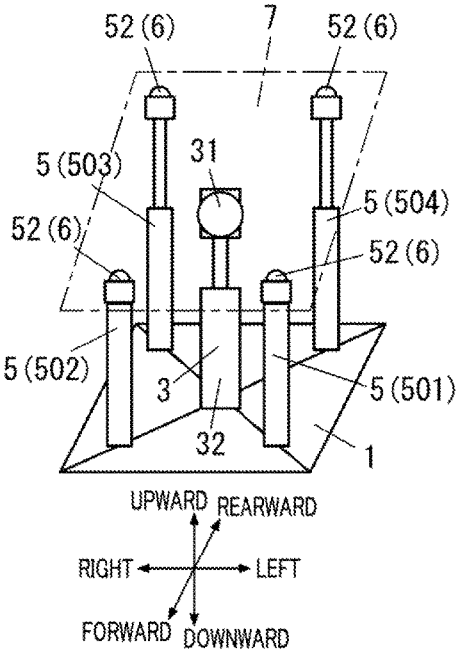
FIG. 6D is a schematic view illustrating a fourth state of the plurality of linear actuators.

FIG. 6D shows that the third actuator 503 and the fourth actuator 504 located on rearward positions are more extended than the first actuator 501 and the second actuator 502 located on forward positions (hereinafter referred to as a "fourth state"). In the fourth state, the second ends 52 of the third actuator 503 and the fourth actuator 504 located on the rearward positions are located higher than the second ends 52 of the first actuator 501 and the second actuator 502 located on the forward positions. In this state, the support 7 is in a posture inclined downward to the front.

The above-described first to fourth states are mere examples of the state of the first to fourth actuators 501, 502, 503, and 504, and various other states can be realized. These various states continuously change to realize various swinging motions of the support 7.

Note that in the swinging apparatus according to the one embodiment, the support 7 is simply mounted on the first to fourth actuators 501, 502, 503, and 504, but since the support 7 is mechanically connected to the coupler 3 including the universal joint 31 which is to be a swinging center, the support 7 for carrying a user does not fall out during the swinging and is stably supported above the base 1.

Here, since the coupler 3 reliably supports the support 7, the first to fourth actuators 501, 502, 503, and 504 suffice as long as they swing the support 7, and a large-size mechanism is not required. That is, in the above-described conventional swinging apparatus, in order to reliably support the support by a plurality of linear actuators, six linear actuators are installed in an inclined posture, which increases the entire size of the mechanism and the installation area. In contrast, in the swinging apparatus according to the one embodiment, it is required only that four linear actuators 5 (first to fourth actuators 501, 502, 503 and 504) are vertically installed, and therefore, the structure is simple, and a large installation area is not required.

Moreover, none of the second ends 52 of the first to fourth actuators 501, 502, 503, and 504 is mechanically connected to the support 7, and the second ends 52 only abut on the lower surface (the lower surface of the buffer member 75) of the support 7. Thus, even when a problem such as a stop of any of the first to fourth actuators 501, 502, 503, and 504 occurs, the occurrence of locking of other mechanisms as a consequence of the stop is reduced, thereby preventing damage to the mechanisms.

Furthermore, since none of the second ends 52 of the first to fourth actuators 501, 502, 503, and 504 is mechanically connected to the support 7, and the second ends 52 are mechanisms which only abut on and support the lower surface (the lower surface of the buffer member 75) of the support 7, various swinging motions of the support 7 are realized by simple control of the first to fourth actuators 501, 502, 503, and 504.

That is, if the first to fourth actuators 501, 502, 503, and 504 are also mechanically connected to the support 7, a lack of precise adjustment of all the first to fourth actuators 501, 502, 503, and 504 in terms of extension drive may cause at least one of the first to fourth actuators 501, 502, 503, and 504 to interfere with the swinging of the support 7, and the support 7 does not operate smoothly. This requires a complicated control program, which increases the term of development and makes it difficult to reduce the fabrication cost.

In contrast, in the swinging apparatus according to the one embodiment, the first to fourth actuators 501, 502, 503, and 504 are mechanically separated from the support 7, and therefore, instantaneous separation of at least one of the first to fourth actuators 501, 502, 503, and 504 from the support 7 is also possible during the swinging of the support 7. Thus, in the swinging apparatus according to the one embodiment, a control program is simple, and the fabrication cost is also reduced.

Since the swinging apparatus according to the one embodiment enables instantaneous separation of at least one of the first to fourth actuators 501, 502, 503, and 504 from the support 7 as described above, it is possible to give a user who rides on the support 7 a feeling of an instantaneous free fall of the support 7 and/or a feeling of an instantaneous inclination of the support 7 by the own weight of the user, and moreover, bodily sensation of a small vibration of the support 7 can be directly given to the user.

The small vibration of the support 7 is realized by, for example, operating the first to fourth actuators 501, 502, 503, and 504 at timings and/or strokes which are not uniform, at a high speed, and at a short stroke of about 10 mm. Also when such a small vibration is given to the support 7, a fall of a user is prevented because the support 7 is stably supported by the base 1 via the coupler 3.

Application Example

The swinging apparatus according to the above-described one embodiment is applicable to various rides as long as they are configured to swing a user who rides on the support 7.

Figure 7:
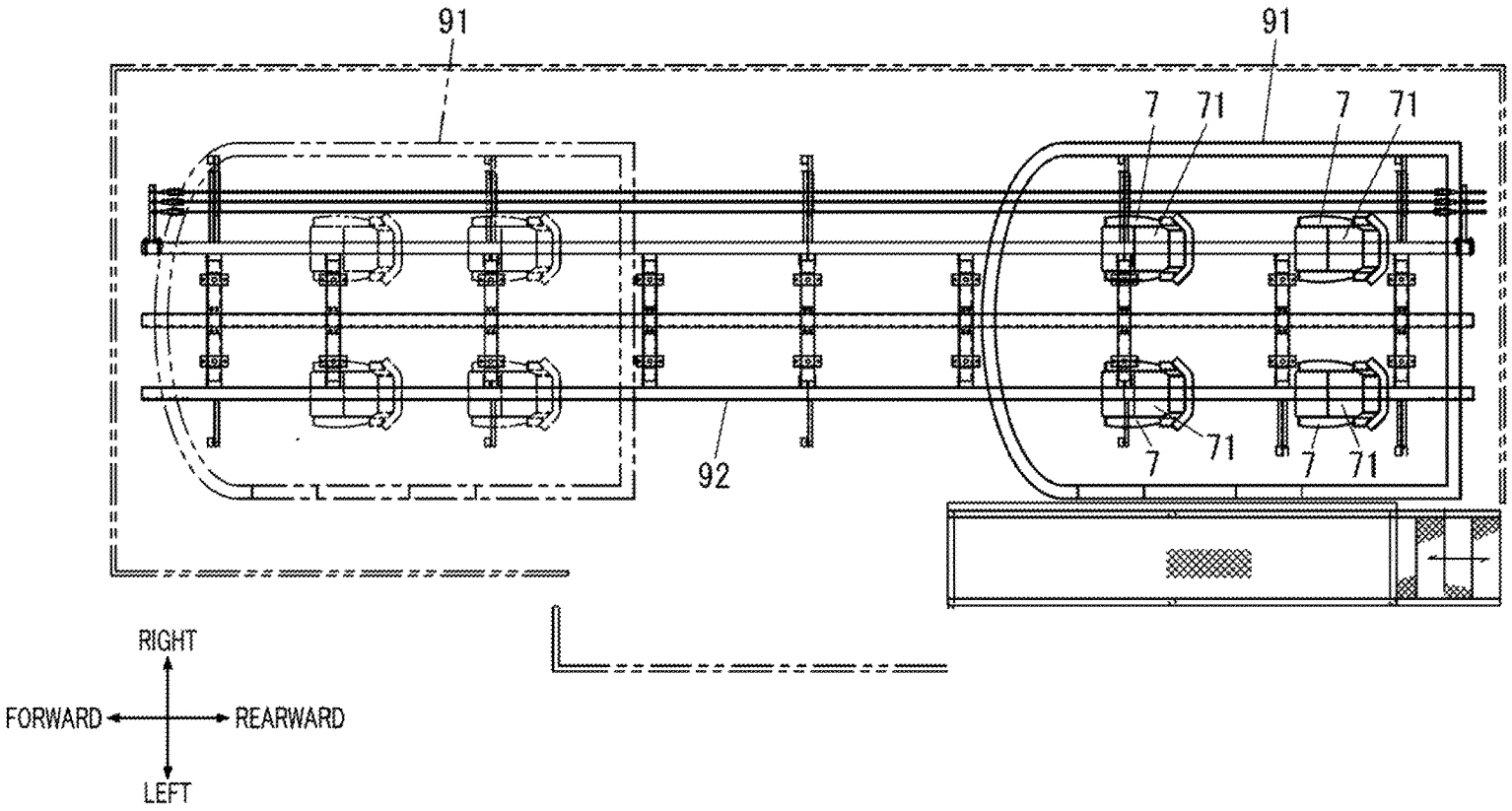
FIG. 7 is a plan view illustrating an amusement ride in which the swinging apparatus is installed.

FIG. 7 shows one example of a ride in which the swinging apparatus according to the one embodiment is installed in a truck 91. The ride of the one example is an amusement ride including the truck 91 in which a plurality of swinging apparatuses are installed, and rails 92 disposed such that the truck 91 runs along the rails 92. An acceleration speed at which the truck 91 runs along the rails 92, and additionally, an acceleration speed of the swinging of the support 7 are given to a user who rides on the support 7 of each swinging apparatus.

Moreover, when a user sets a head mount display apparatus on the head of the user, the acceleration speed at which the truck 91 runs and the acceleration speed of the swinging of the support 7 are given to the user immersed in images displayed on the head mount display apparatus and sound. Here, the images displayed on the head mount display apparatus and the sound are preferably in synchronization with a program for swinging the support 7 and a program for causing the truck 91 to run.

In the ride according to the one example, the rails 92 are rails having starting ends and terminating ends and being linear in a plan view. However, the rails 92 may be rails being curved in a plan view or rails having a shape including a linear part and a curved part in combination in a plan view, or such rails may also be combined with a difference in height. Alternatively, the rails 92 may have a loop shape.

Moreover, a user does not wear the head mount display, but an image may be projected onto a screen disposed along the rails 92, or various types of sets may be displayed along the rails 92 for appreciation by the user.

Figure 8:
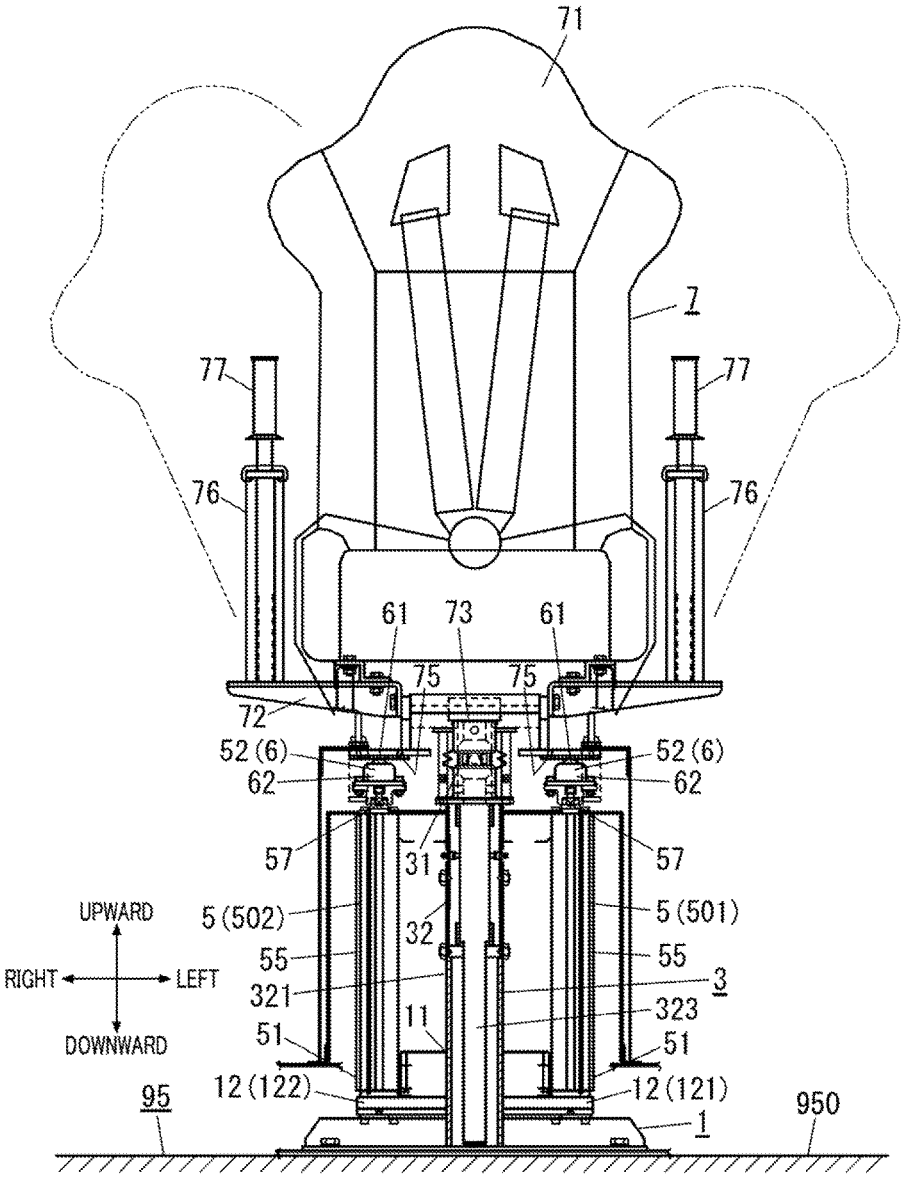
FIG. 8 is a partially cutaway front view illustrating another amusement ride in which the swinging apparatus is installed.

According to the one example, the swinging apparatuses are installed in the truck 91 of the ride. However, the swinging apparatuses may be installed on a floor 950 of a building 95 as illustrated in FIG. 8. Also in this case, when a user sets a head mount display apparatus on the head of the user, an acceleration speed of the swinging of the support 7 is given to the user immersed in images displayed on the head mount display apparatus and sound. Alternatively, an appropriate screen may be installed around the swinging apparatuses in the building 95, and images may be projected onto the screen, or various sets may be installed around the swinging apparatuses in the building 95 for appreciation by the user.

First Variation

Next, with reference to FIG. 9, a swinging apparatus according to a first variation will be described.

In the swinging apparatus according to the first variation, some configurations of the swinging apparatus according to the above-described one embodiment have been changed. In the following description, configurations of the swinging apparatus according to the first variation which are similar to those of the swinging apparatus of the one embodiment are denoted by the same reference signs as those of the one embodiment, and the description thereof will be omitted.

Figure 9:
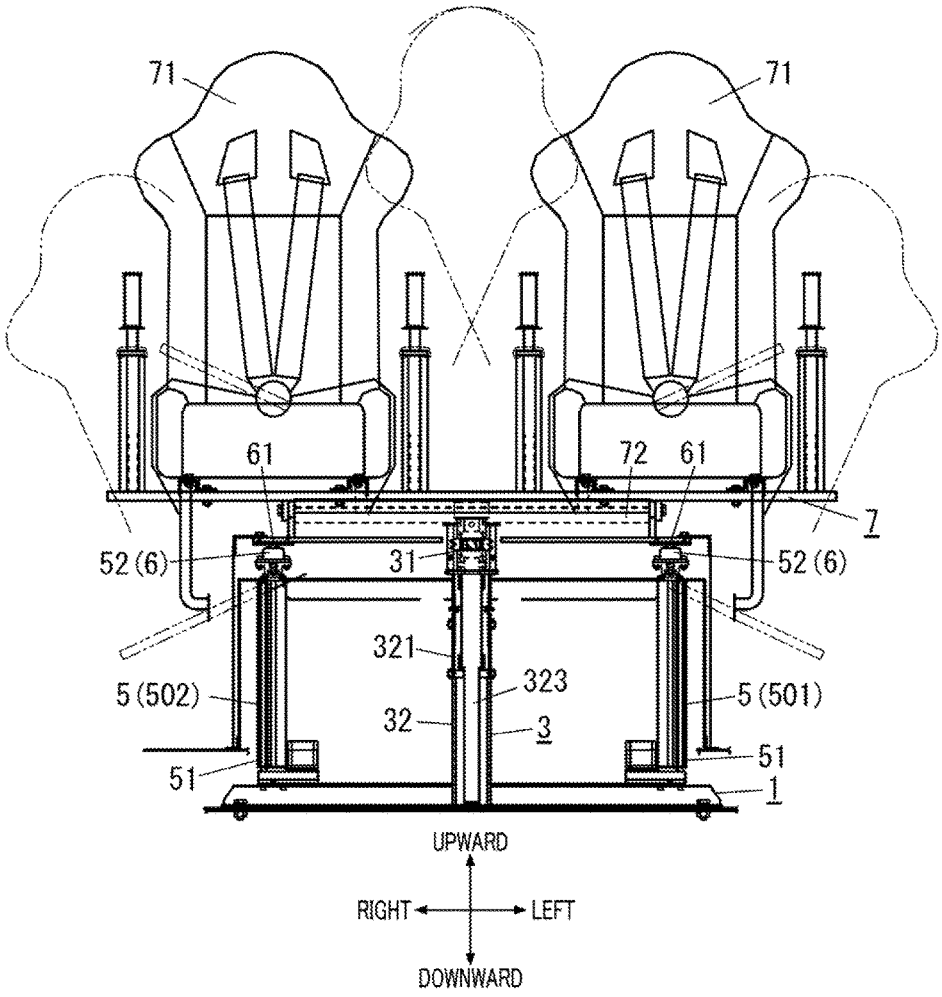
FIG. 9 is a partially cutaway front view illustrating a swinging apparatus of a first variation.

In the swinging apparatus according to the first variation shown in FIG. 9, a support 7 has a base seat section 72 on which two seats 71 are aligned and installed. When users sit on the respective two seats 71, the two users can be simultaneously swung.

Note that the configuration of the support 7 is not limited to the above-described configuration. Three or more seats 71 may be installed, or a bench seat on which a plurality of users can sit may be installed. Alternatively, the support 7 may be configured such that one or more users ride in an upright posture on the support 7.

Second Variation

Next, with reference to FIGS. 10 to 12, a swinging apparatus according to a second variation will be described.

In the swinging apparatus according to the second variation, some configurations of the swinging apparatus according to the above-described one embodiment have been changed. In the following description, configurations of the swinging apparatus according to the second variation which are similar to those of the swinging apparatus of the one embodiment are denoted by the same reference signs as those of the one embodiment, and the description thereof will be omitted.

Figure 10:
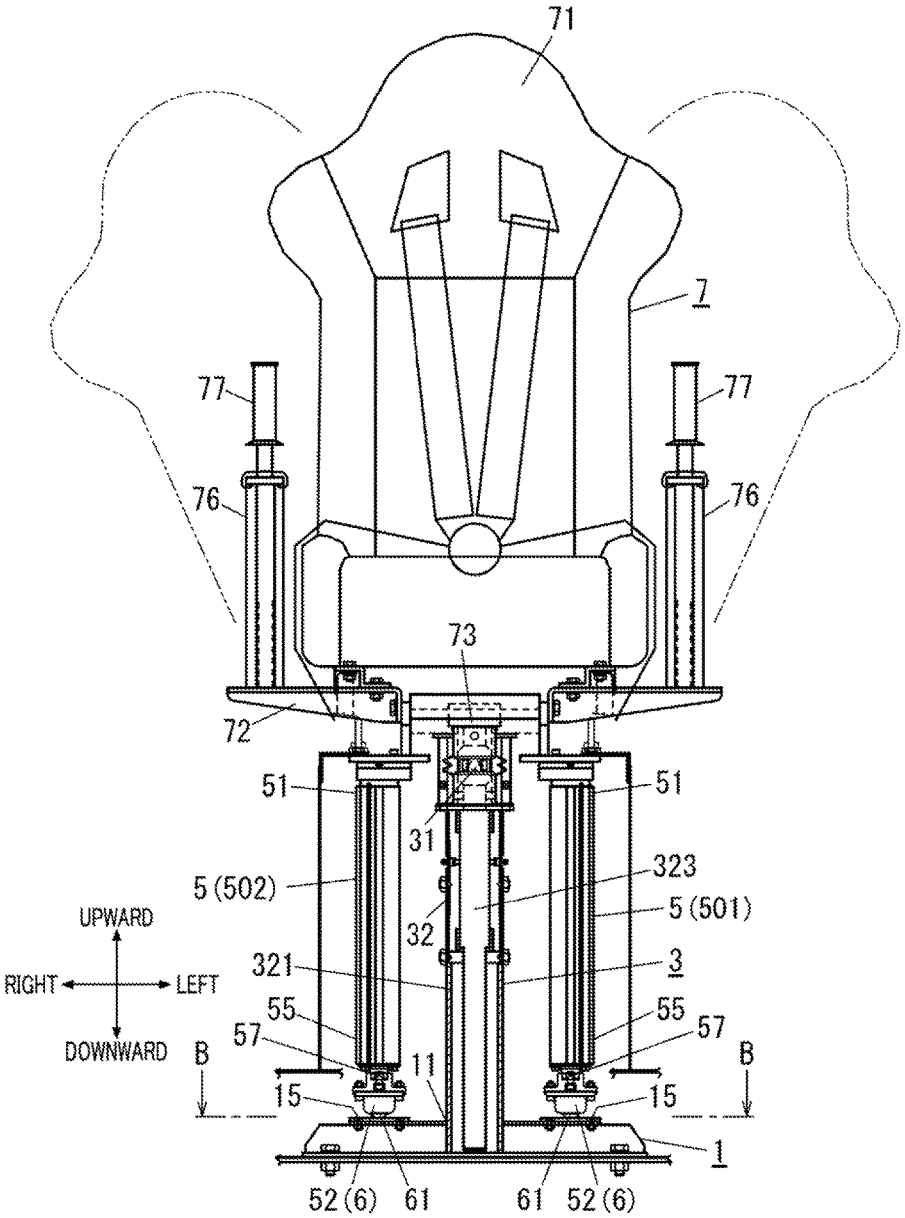
FIG. 10 is a partially cutaway front view illustrating a swinging apparatus of a second variation.
Figure 11:
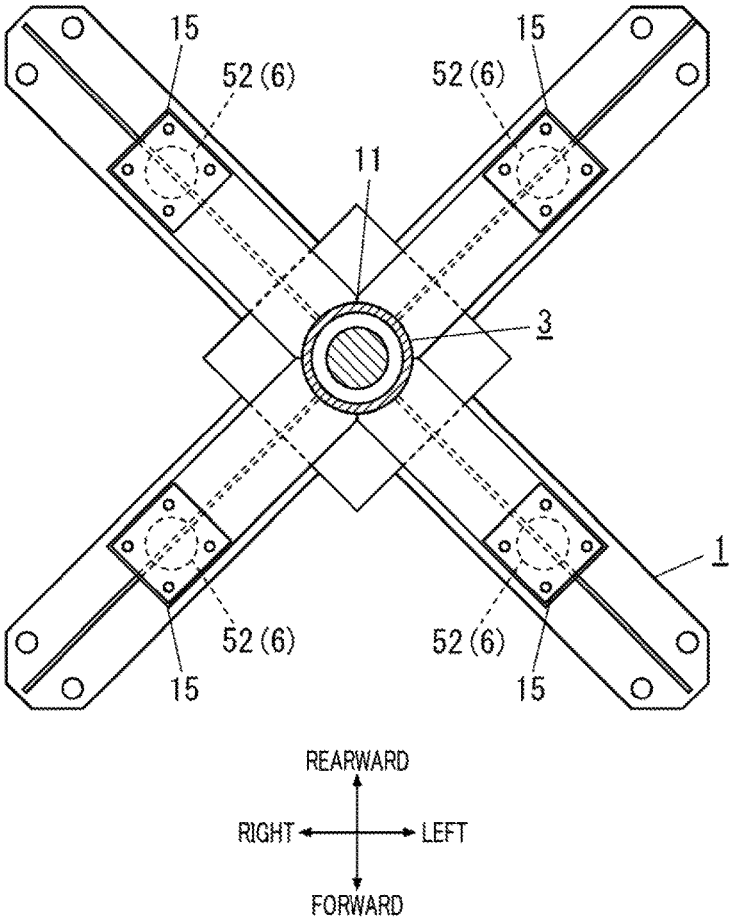
FIG. 11 is a sectional view taken along line B-B in FIG. 10.
Figure 12:
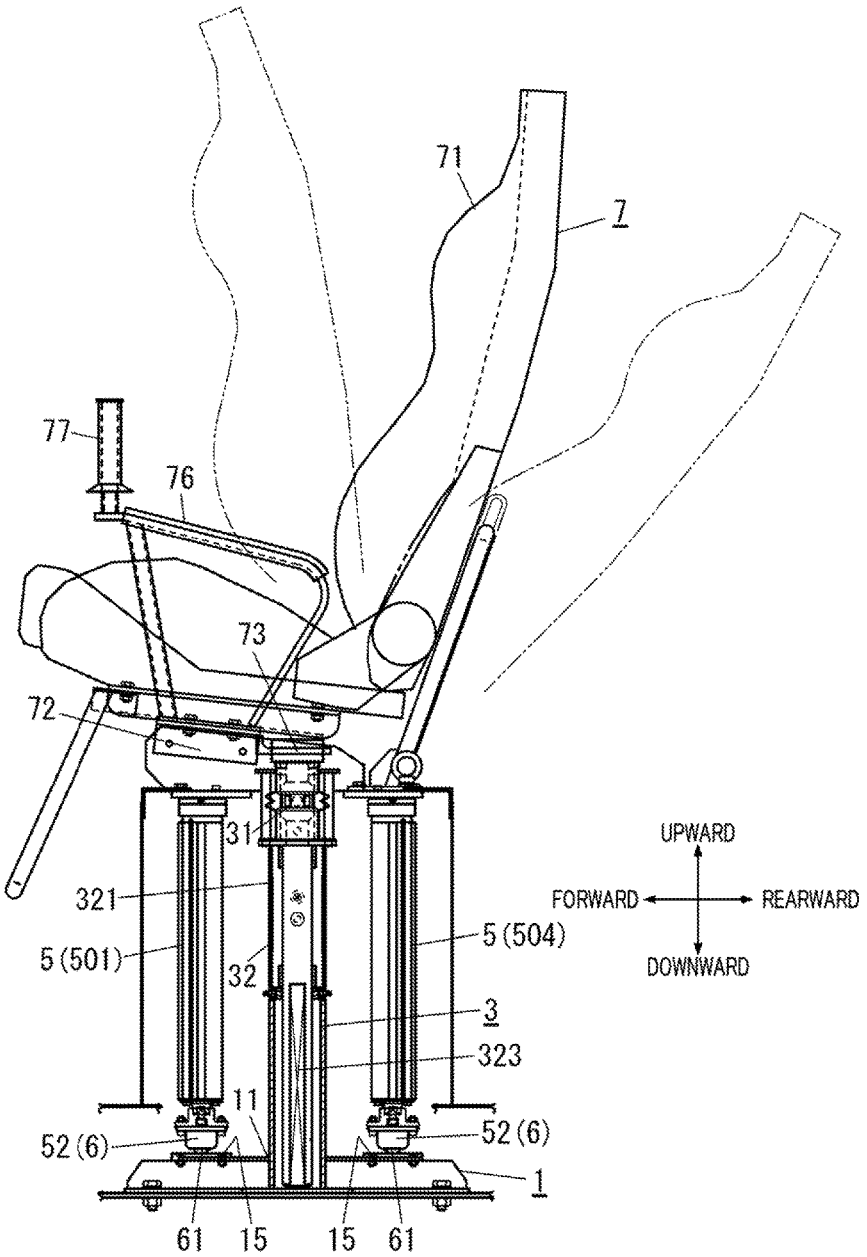
FIG. 12 is a partially cutaway side view illustrating the swinging apparatus.

In the swinging apparatus according to the second variation shown in FIGS. 10 to 12, linear actuators 5 are not mechanically connected to the base 1 but are mechanically connected to a support 7.

Each linear actuator 5 includes a first end 51 and a second end 52 (a ball roller 6) on opposing sides. The first end 51 is mechanically connected to the support 7, and the second end 52 is configured to move freely touching an upper surface of the base 1.

Each linear actuator 5 protrudes vertically downward from a lower surface of the support 7. In other words, each linear actuator 5 has an upside-down structure of the linear actuator 5 of the swinging apparatus according to the one embodiment shown FIG. 1 and other figures.

The base 1 has an upper portion in which a plurality of (four) buffer members 15 are integrally provided. The plurality of buffer members 15 are located on an identical circumference with a connection section 11 of the base 1 as the center and are located a distance (an equal distance) away from each other in the circumferential direction.

Each of the buffer members 15 has an upper surface which the ball roller 6 (ball 61) of the corresponding linear actuator 5 is touching from above. The upper surface of each buffer member 15 has a part which the ball 61 is touching, and the part can move in all directions including the forward-rearward direction and the right-left direction in the upper surface of the buffer member 15 along with the rotation of the ball 61. Each buffer member 15 is made of, for example, ultrahigh molecular weight polyethylene, but other materials may be adopted as long as they have a shock-absorbing property and a wear-resistant property.

The four buffer members 15 are separately formed, but two or more buffer members 15 may be integrally formed.

In the swinging apparatus according to the second variation, first to fourth actuators 501, 502, 503, and 504 are simply mounted on the base 1, but since the support 7 and the base 1 are mechanically connected to each other via a coupler 3 including a universal joint 31 serving as an swinging center, the support 7 does not fall out during the swinging and is stably supported above the base 1.

Also in the swinging apparatus according to the second variation, the loads of the support 7 and a user who rides on the support 7 are reliably supported by the coupler 3, and the first to fourth actuators 501, 502, 503, and 504 suffice as long as they provide force to swing the support 7, and therefore, the entire size of the swinging apparatus is compact. Moreover, the first to fourth actuators 501, 502, 503, and 504 are mechanically separated from the base 1, and therefore, even when a problem such as a stop of any of the first to fourth actuators 501, 502, 503, and 504 occurs, the occurrence of locking of other mechanisms as a consequence of the stop is reduced, thereby preventing damage to the mechanisms.

Moreover, in the swinging apparatus according to the second variation, since the first to fourth actuators 501, 502, 503, and 504 are mechanically separated from the base 1, at least one of the first to fourth actuators 501, 502, 503, and 504 may be instantaneously separated from the base 1 during the swinging of the support 7. Thus, the support 7 can be freely swung in various aspects without requiring a complicated control program.

Third Variation

Figure 13:
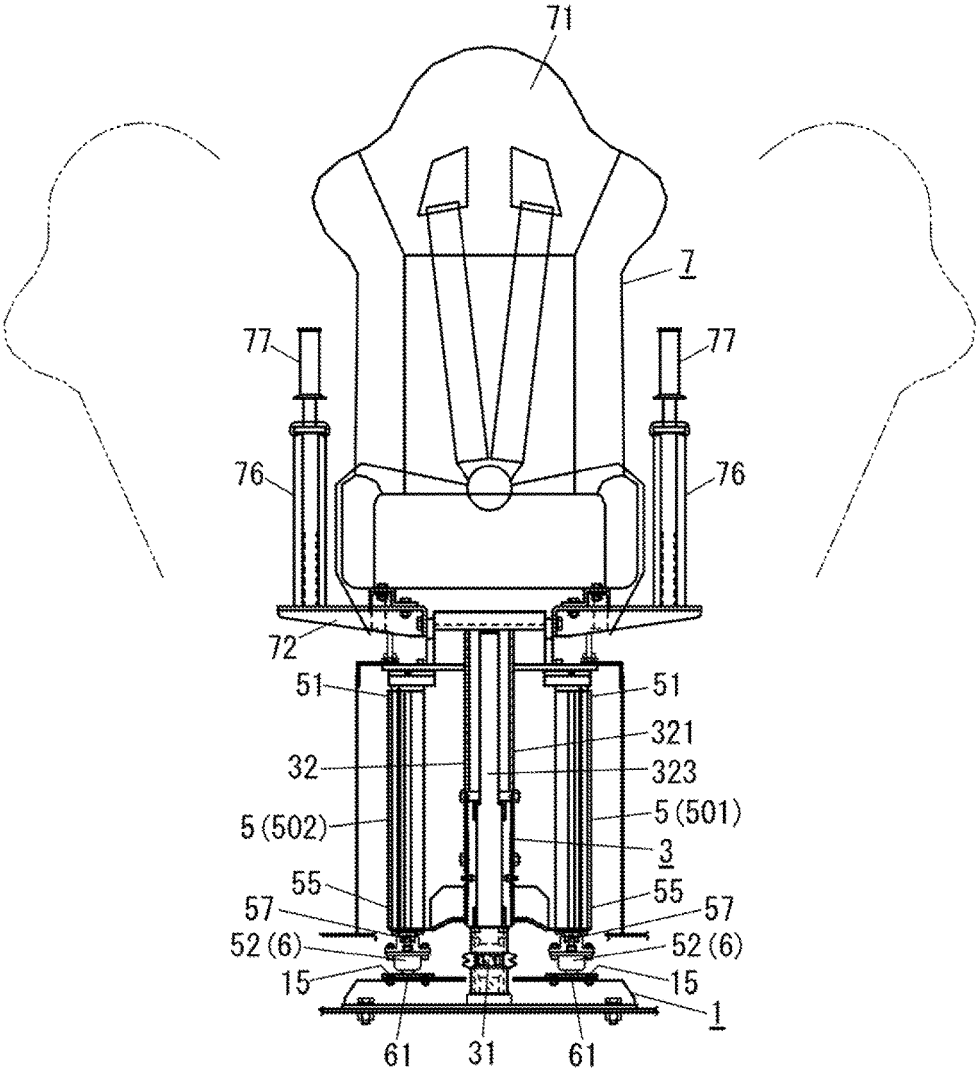
FIG. 13 is a partially cutaway front view illustrating a swinging apparatus of a third variation.

Next, with reference to FIG. 13, a swinging apparatus according to a third variation will be described.

In the swinging apparatus according to the third variation, some configurations of the swinging apparatus according to the above-described one embodiment have been changed. In the following description, configurations of the swinging apparatus according to the third variation which are similar to those of the swinging apparatus of the one embodiment are denoted by the same reference signs as those of the one embodiment, and the description thereof will be omitted.

In the swinging apparatus according to the third variation, each of the linear actuators 5 is not mechanically connected to a base 1 but is mechanically connected to a support 7. That is, similarly to the swinging apparatus of the second variation, each linear actuator 5 in the swinging apparatus according to the third variation includes a first end 51 and a second end 52 (a ball roller 6) on opposing sides. The first end 51 is mechanically connected to the support 7, and the second end 52 is configured to freely move touching an upper surface of the base 1.

Additionally, in the swinging apparatus according to the third variation, a universal joint 31 serving as a swinging center of the support 7 is not located above a coupling column 32 which is freely extendable and contractible, but the universal joint 31 is located below the coupling column 32.

Thus, in the swinging apparatus according to the third variation, the swinging center of the support 7 is close to the base 1, and a large radius of rotation of the swinging is determined. Moreover, in the swinging apparatus according to the third variation, the radius of rotation (distance between the support 7 and the universal joint 31) of the support 7 changes along with passive extension and contraction of the coupling column 32, thereby realizing swinging motions with more variations.

Fourth Variation

Next, with reference to FIGS. 14 to 17, a swinging apparatus of a fourth variation will be described.

In the swinging apparatus according to the fourth variation, some configurations of the swinging apparatus according to the above-described one embodiment have been changed. In the following description, configurations of the swinging apparatus according to the fourth variation which are similar to those of the swinging apparatus of the one embodiment are denoted by the same reference signs as those of the one embodiment, and the description thereof will be omitted.

Figure 15:
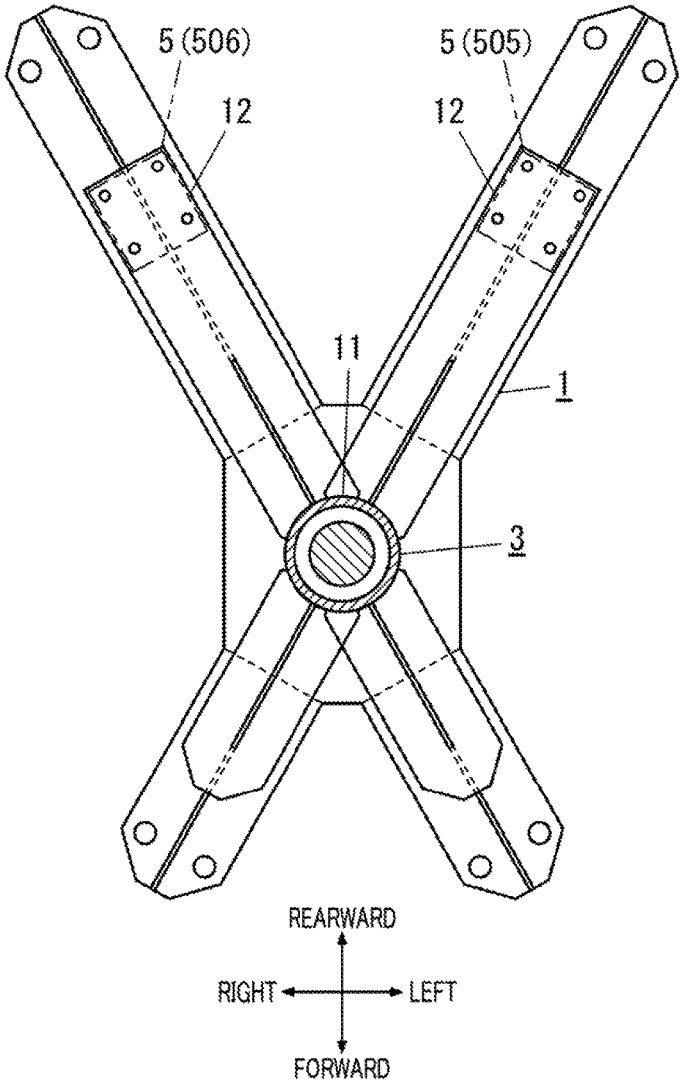
FIG. 15 is a sectional view taken along line C-C in FIG. 14.

In the swinging apparatus according to the fourth variation, a plurality of linear actuators 5 are not arranged to surround a coupler 3, but the coupler 3 and the plurality of linear actuators 5 are arranged to be aligned on a circumference in a plan view (see FIG. 15).

The coupler 3 is located in front of the two linear actuators 5. The two linear actuators 5 are located a distance away from each other in the right-left direction.

A base 1 includes a connection section 11 and two, right and left connection sections 12. To the connection section 11, a lower end of the coupler 3 is mechanically connected. To each of the two, right and left connection sections 12, a lower end of each of the two linear actuators 5 is mechanically connected. The distance between the left connection section 12 and the connection section 11 is equal to the distance between the right connection section 12 and the connection section 11.

In the following description, when the two linear actuators 5 are distinguished from each other, the linear actuator 5 on the left is referred to as a left actuator 505 and the linear actuator 5 on the right is referred to as a right actuator 506.

In the swinging apparatus according to the fourth variation, a first end 51 of the left actuator 505 is connected to the left connection section 12, and a first end 51 of the right actuator 506 is connected to the right connection section 12.

A support 7 has a base seat section 72 provided with two, right and left buffer members 75. The left buffer member 75 has a lower surface which a second end 52 (ball roller 6) of the left actuator 505 freely moves touching. The right buffer member 75 has a lower surface which a second end 52 (ball roller 6) of the right actuator 506 freely moves touching.

Figure 17:
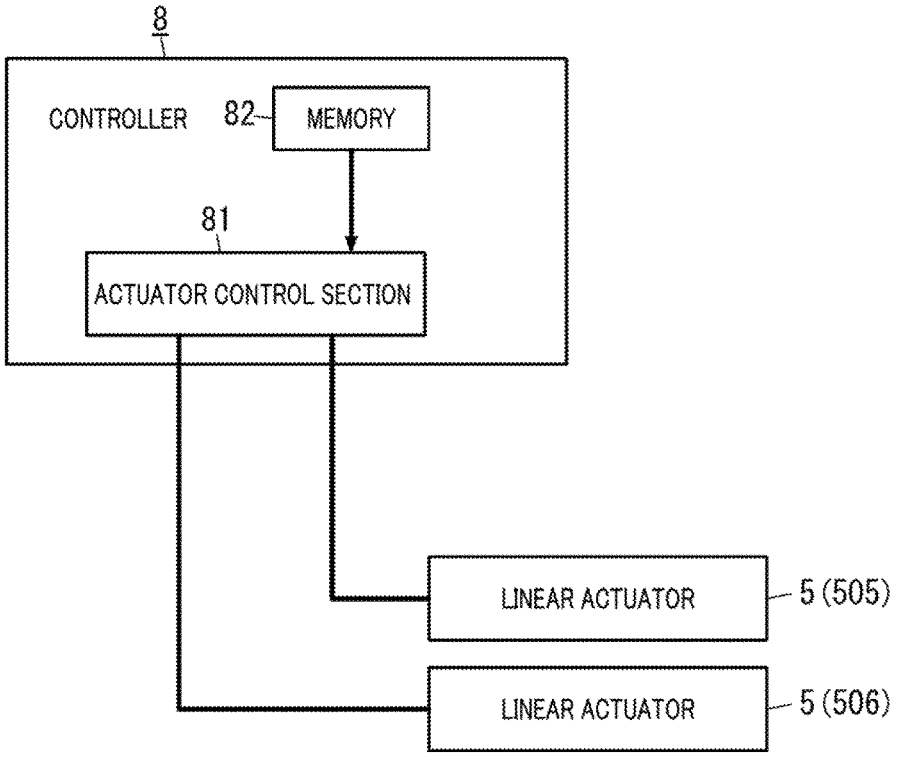
FIG. 17 is a block diagram illustrating a controller included in the swinging apparatus.

A controller 8 includes memory 82 and an actuator control section 81 configured to control the extension and contraction movement of the left actuator 505 and the right actuator 506 according to a program stored in the memory 82 (see FIG. 17). The left actuator 505 and the right actuator 506 are driven so as to realize various swinging motions of the support 7 with a universal joint 31 as the center.

In the swinging apparatus according to the fourth variation, the coupler 3 is located in front of the left actuator 505 and the right actuator 506, but the coupler 3 may be located behind the left actuator 505 and the right actuator 506.

Figure 14:
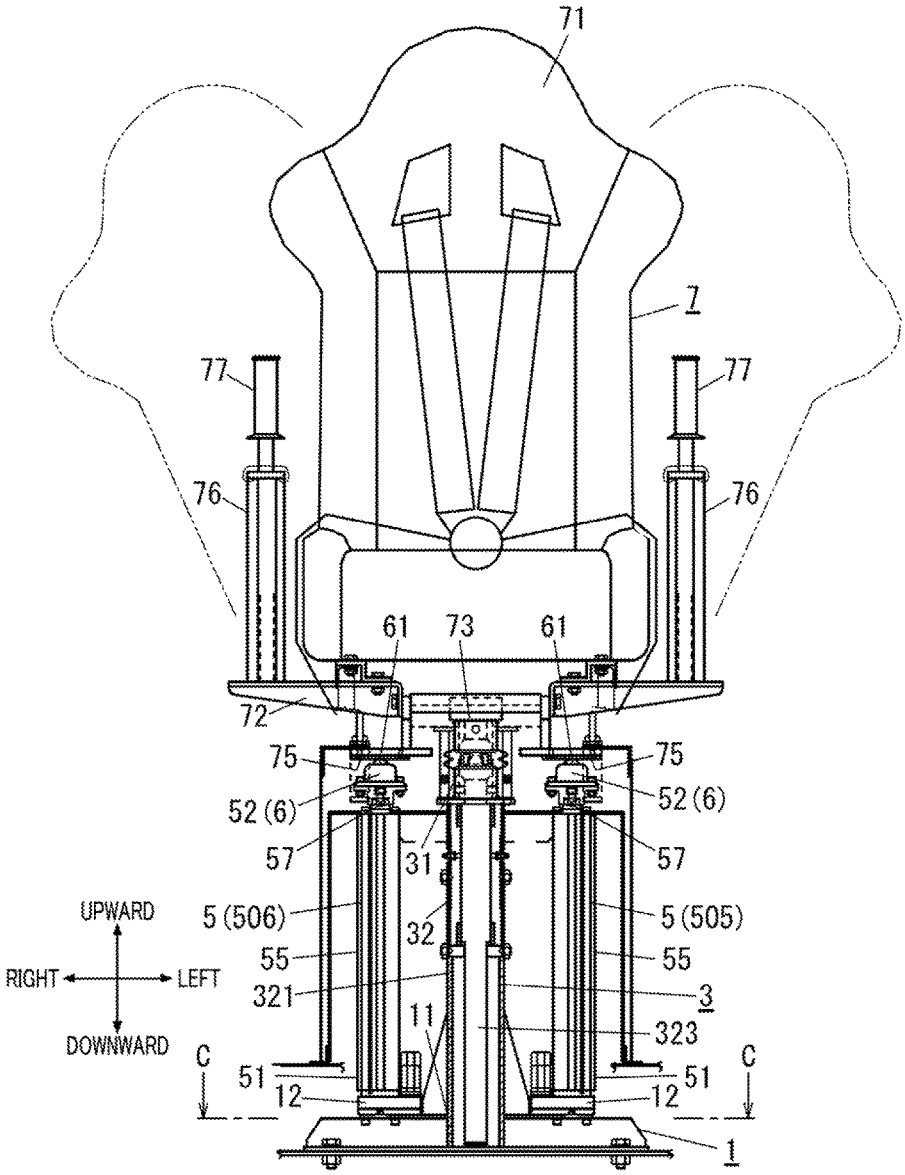
FIG. 14 is a partially cutaway front view illustrating a swinging apparatus of a fourth variation.
Figure 16:
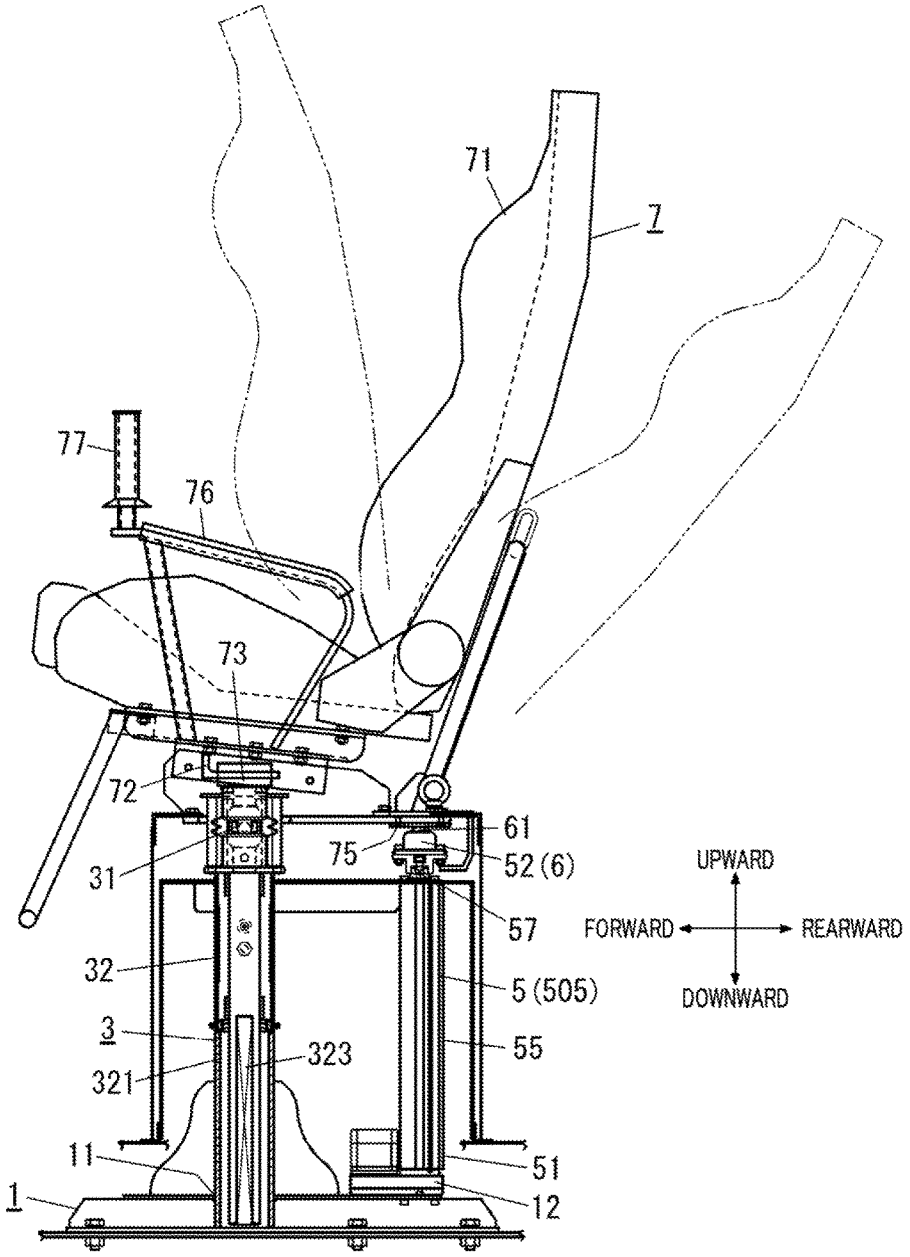
FIG. 16 is a partially cutaway side view illustrating the swinging apparatus.

As illustrated in FIGS. 14 to 16, when the coupler 3 is located in front of the left actuator 505 and the right actuator 506, the entire support 7 can be swung to move the buttocks of a user who sits on a seat 71 upward and downward. When the coupler 3 is located behind the left actuator 505 and the right actuator 506, the entire support 7 can be swung to move an anterior body portion of a user who sits on the seat 71 upward and downward, wherein the proximity of the buttocks of the user is defined as the center, and the anterior body portion is a portion located anterior to the center.

Others

While the swinging apparatus according to the one embodiment and the amusement ride including the swinging apparatus and the swinging apparatuses according to the first to fourth variations have been described above, the design of these swinging apparatus and the amusement ride may be accordingly modified, or the configurations of the variations may be accordingly combined with each other.

For example, in the swinging apparatus according to the one embodiment and in the first, second, and fourth variations, the universal joint 31 is located at the upper end of the coupler 3, and in the third variation, the universal joint 31 is located at the lower end of the coupler 3, but the present invention is not limited to these embodiment and variations, and the portion of the coupler 3 at which the universal joint 31 is located may be accordingly determined in a position between the upper end and the lower end of the coupler 3.

In the swinging apparatus according to each of the one embodiment and the first to third variations, four linear actuators 5 are arranged, but the number of the plurality of linear actuators 5 to be arranged may be other than four. In the swinging apparatus according to the fourth variation, two linear actuators 5 are arranged, but three or more linear actuators 5 may be arranged.

In the swinging apparatus according to each of the one embodiment and the first and fourth variations, all the linear actuators 5 are connected to the base 1, and in the swinging apparatus according to each of the second and third variations, all the linear actuators 5 are connected to the support 7, but a linear actuator 5 connected to the base 1 and a linear actuator 5 connected to the support 7 may be provided together.

In the swinging apparatus according to each of the one embodiment and the first to fourth variations, the coupling column 32 included in the coupler 3 is freely extendable and contractible in the vertical direction, but the coupling column 32 may be configured not to be extended or contracted. Moreover, in the swinging apparatus according to the fourth variation, the coupling column 32 may include a linear actuator configured to extend and contract actively.

Effects

As can be seen from the description of the swinging apparatus in each of the one embodiment and the first to fourth variations, a swinging apparatus according to a first aspect includes a base (1), a support (7), a coupler (3), and linear actuators (5). The support (7) is installed above the base (1) and configured to carry a user. The coupler (3) is disposed between the base (1) and the support (7) and includes a universal joint (31) that couples the support (7) to the base (1) and that allows the support to swing freely. The linear actuators (5) are disposed between the base (1) and the support (7) so that in a plan view the linear actuators (5) are located a distance away from each other at locations away from the universal joint (31).

Each of the linear actuators (5) includes a first end (51) and a second end (52). The first end (51) is mechanically connected to one of the base (1) and the support (7). The second end (52) is located on an opposing side to the first end (51) and is configured to freely move touching a surface of the other of the base (1) and the support (7).

In the swinging apparatus according to the first aspect, the support (7) is supported by the coupler 3 so as not to fall over. Thus, the linear actuators (5) are required only to give the support (7) force for swinging the support (7), thereby realizing a compact mechanism. Moreover, each of the linear actuators (5) is mechanically separated from the base (1) or the support (7), and therefore, even when a problem such as a stop of any one of the linear actuators (5) occurs, the influence of the problem over the entire mechanism can be suppressed, which prevents damage to the mechanism. Further, in the swinging apparatus according to the first aspect, since each of the linear actuators (5) is mechanically separated from the base (1) or the support (7), complicated control for precisely coordinating the linear actuators (5) in terms of the extension and contraction movement is not essential, and various swinging motions of the support (7) can be realized by simple control. Furthermore, since each of the linear actuators (5) is mechanically separated from the base (1) or the support (7), it is possible to give a user who rides on the support 7 a feeling of an instantaneous free fall, a feeling of instantaneous inclination of the weight of the user, and/or a direct bodily sensation of a small vibration of the support (7).

As can be seen from the description of the swinging apparatus in each of the one embodiment and the first to fourth variations, in a swinging apparatus according to a second aspect referring to the swinging apparatus according to the first aspect, the second end (52) includes a ball roller (6).

According to the swinging apparatus of the second aspect, scrapes of the base (1) or the support (7) with the second end (52) of the linear actuator (5) is reduced, and the durability of the swinging apparatus is enhanced.

As can be seen from the description of the swinging apparatus in each of the one embodiment and the first to fourth variations, in a swinging apparatus according to a third aspect referring to the swinging apparatus according to the first or second aspect, the coupler (3) further includes a coupling column (32) freely extendable and contractible in a vertical direction.

According to the swinging apparatus of the third aspect, the coupling column (32) including the universal joint (31) is passively extended and contracted along with active extension and contraction of the linear actuators (5). Thus, as the motion of the support (7), various movements including the swinging with the universal joint (31) as the center and the upward and downward movement in combination are realized.

As can be seen from the description of the swinging apparatus in each of the one embodiment and the first, second, and fourth variations, in a swinging apparatus according to a fourth aspect referring to the swinging apparatus according to the third aspect, the universal joint (31) is located between the coupling column (32) and the support (7).

According to the swinging apparatus of the fourth aspect, the support (7) can be swung in a relatively small radius of rotation with a portion in the proximity of the support (7) as the center.

As can be seen from the description of the swinging apparatus according to the third variation, in a swinging apparatus according to a fifth aspect referring to the swinging apparatus according to the third aspect, the universal joint (31) is located between the coupling column (32) and the base (1).

According to the swinging apparatus of the fifth aspect, the support (7) can be swung in a relatively large radius of rotation with a portion in the proximity of the base (1) as the center. Moreover, since the radius of rotation of the support (7) changes along with the extension and contraction of the coupling column (32), swinging motions with more variations can be realized.

As can be seen from the description of the swinging apparatus according to each of the one embodiment and the first and fourth variations, in a swinging apparatus according to a sixth aspect referring to the swinging apparatus according to any one of the first to fifth aspects, the first end (51) is mechanically connected to the base (1), and the second end (52) is configured to freely move touching a lower surface of the support (7).

According to the swinging apparatus of the sixth aspect, a structure for connecting each of the linear actuator (5) to the coupler (3) may be provided to the base (1) having a relatively high degree of freedom of design.

As can be seen from the description of the swinging apparatus according to each of the one embodiment and the first and fourth variations, in a swinging apparatus according to a seventh aspect referring to the swinging apparatus according to the sixth aspect, the support (7) includes a buffer member (75), and the buffer member (75) is configured such that the second end (52) freely move touching a lower surface of the buffer member (75).

According to the swinging apparatus of the seventh aspect, the durability of the swinging apparatus is enhanced, and additionally, the occurrence of abnormal noise during the swinging of the support (7) is reduced.

As can be seen from the description of the swinging apparatus according to the second and third variations, in a swinging apparatus according to any one of the first to fifth aspects referring to the swinging apparatus of the eighth aspect, the first end (51) is mechanically connected to the support (7), and the second end (52) is configured to freely move touching an upper surface of the base (1).

According to the swinging apparatus of the eighth aspect, a surface which each linear actuator (5) freely moves touching may be provided to the base (1) having a relatively high degree of freedom of design.

As can be seen from the description of the swinging apparatus according to the second and third variations, in a swinging apparatus according to a ninth aspect referring to the swinging apparatus according to the eighth aspect, the base (1) includes a buffer member (15), and the buffer member (15) is configured such that the second end (52) freely move touching an upper surface of the buffer member (15).

According to the swinging apparatus of the ninth aspect, the durability of the swinging apparatus is enhanced, and additionally, the occurrence of abnormal noise during the swinging of the support (7) is reduced.

As can be seen from the description of the swinging apparatus in each of the one embodiment and the first to third variations, in a swinging apparatus according to a tenth aspect referring to any one of the first to ninth aspect, the linear actuators (5) include three or more linear actuators (5) located a distance away from each other to surround the coupler (3) in a plan view.

According to the swinging apparatus of the tenth aspect, an active extension and contraction movement of each of the three or more linear actuators (5) located to surround the coupler (3) realizes various swinging motions of the support (7) in all directions.

As can be seen from the description of the swinging apparatus according to the fourth variation, in a swinging apparatus according to an eleventh aspect referring to the swinging apparatus of any one of first to ninth aspects, the support (7) includes at least one seat (71) configured such that a user sits on the at least one seat (71) in a posture facing forward, and the coupler (3) and the linear actuators (5) are located on an identical circumference in a plan view.

According to the swinging apparatus of the eleventh aspect, the support (7) can be swung in all directions by a relatively small number of linear actuators (5).

As can be seen from the description of the swinging apparatus in each of the one embodiment and the first to fourth variations, in a swinging apparatus according to a twelfth aspect referring to the swinging apparatus of any one of the first to eleventh aspects, each of the linear actuators (5) is provided in parallel to the coupler (3).

According to the swinging apparatus of the twelfth aspect, even when the linear actuators (5) are each configured to have a long entire length, an increase in the installation area of the base (1) can be suppressed. In other words, without requiring a large installation area, the linear actuators (5) may be configured to have a long entire length so as to achieve a large traveling distance of the support (7) in the vertical direction.

As can be seen from the description of the application example of the swinging apparatus according to the one embodiment, an amusement ride according to a first aspect includes the swinging apparatus according to any one of the first to twelfth aspects, a truck (91) in which the swinging apparatus is installed, and a rail (92) installed such that the truck (91) runs on the rail.

According to the amusement ride of the first aspect, simple control using a compact and highly safe mechanism can realize the various swinging motions of the support (7) and can freely combine the swinging of the support (7) and the running of the truck (91) with each other.

As can be seen from the description of the application example of the swinging apparatus according to the one embodiment, an amusement ride according to a second aspect includes the swinging apparatus according to any one of the first to twelfth aspects, and a floor (950) of a building (95), the base of the swinging apparatus being installed on the floor (95).

The amusement ride according to the second aspect can provide an amusement ride in which simple control using a compact and highly safe mechanism realizes various swinging motions of the support (7), and a user can play a game using the swinging of the support (7).

REFERENCE SIGNS LIST

1 Base
15 Buffer Member
3 Coupler
31 Universal Joint
32 Coupling Column
5 Linear Actuator

51 First End
52 Second End
6 Ball Roller
7 Support
71 Seat
75 Buffer Member
91 Truck
92 Rail

The invention claimed is:

1. A swinging apparatus, comprising:
a base;
a support installed above the base and configured to carry a user;
a coupler disposed between the base and the support and including a universal joint that couples the support to the base and that allows the support to swing freely; and
linear actuators disposed between the base and the support so that in a plan view the linear actuators are located a distance away from each other at locations away from the universal joint, wherein
each of the linear actuators includes
a first end mechanically connected to one of the base and the support, and
a second end located on an opposing side to the first end, the second end being movable while touching a surface of a remaining one of the base and the support.

2. The swinging apparatus according to claim 1, wherein the second end includes a ball roller.

3. The swinging apparatus according to claim 1, wherein the coupler further includes a coupling column freely extendable and contractible in a vertical direction.

4. The swinging apparatus according to claim 3, wherein the universal joint is located between the coupling column and the support.

5. The swinging apparatus according to claim 3, wherein the universal joint is located between the coupling column and the base.

6. The swinging apparatus according to claim 1, wherein the first end is mechanically connected to the base, and the second end is movable while touching a lower surface of the support.

7. The swinging apparatus according to claim 6, wherein the support comprises a buffer member, and
the buffer member is configured such that the second end is movable while touching a lower surface of the buffer member.

8. The swinging apparatus according to claim 6, wherein the coupler further includes a coupling column freely extendable and contractible in a vertical direction.

9. The swinging apparatus according to claim 8, wherein the universal joint is located between the coupling column and the support.

10. The swinging apparatus according to claim 8, wherein the universal joint is located between the coupling column and the base.

11. The swinging apparatus according to claim 1, wherein the first end is mechanically connected to the support, and the second end is movable while touching an upper surface of the base.

12. The swinging apparatus according to claim 11, wherein
the base includes a buffer member, and
the buffer member is configured such that the second end is movable while touching an upper surface of the buffer member.

13. The swinging apparatus according to claim 11, wherein
the coupler further includes a coupling column freely extendable and contractible in a vertical direction.

14. The swinging apparatus according to claim 13, wherein
the universal joint is located between the coupling column and the support.

15. The swinging apparatus according to claim 13, wherein
the universal joint is located between the coupling column and the base.

16. The swinging apparatus according to claim 1, wherein the linear actuators include three or more linear actuators located the distance away from each other to surround the coupler in a plan view.

17. The swinging apparatus according to claim 1, wherein the support includes at least one seat configured such that a user sits on the at least one seat in a posture facing forward, and
the coupler and the linear actuators are located on an identical circumference in a plan view.

18. The swinging apparatus according to claim 1, wherein each of the linear actuators is provided in parallel to the coupler.

19. An amusement ride, comprising:
the swinging apparatus according to claim 1,
a truck in which the swinging apparatus is installed, and
a rail installed such that the truck runs on the rail.

20. An amusement ride, comprising:
the swinging apparatus according to claim 1, and
a floor of a building, the base of the swinging apparatus being installed on the floor.

* * * * *